US007012204B2

(12) United States Patent
Chou

(10) Patent No.: US 7,012,204 B2
(45) Date of Patent: Mar. 14, 2006

(54) SILVER CONTACT FIXING STRUCTURE FOR CONDUCTIVE BLADES

(75) Inventor: Chin-Wen Chou, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 28 days.

(21) Appl. No.: 10/802,748

(22) Filed: Mar. 18, 2004

(65) Prior Publication Data

US 2005/0205401 A1 Sep. 22, 2005

(51) Int. Cl.
*H01H 1/00* (2006.01)

(52) U.S. Cl. ..... 200/238; 29/622; 29/861; 200/239; 200/246; 200/283

(58) Field of Classification Search ..... 29/874, 29/882, 861–865, 854, 857, 825, 622; 200/237–239, 200/245, 246, 271, 283, 284
See application file for complete search history.

(56) References Cited

U.S. PATENT DOCUMENTS 4,259,557 A * 3/1981 Takano ..... 200/275
4,364,173 A * 12/1982 Broadhurst ..... 29/882
4,642,891 A * 2/1987 Weik et al. ..... 29/879
5,263,353 A * 11/1993 Bakermans et al. ..... 72/334
5,712,611 A * 1/1998 Mattes et al. ..... 337/334

FOREIGN PATENT DOCUMENTS

CN 448454 A 1/2000

* cited by examiner

*Primary Examiner*—Michael A. Friedhofer
(74) *Attorney, Agent, or Firm*—Birch, Stewart, Kolasch & Birch, LLP

(57) ABSTRACT

A silver contact fixing structure for conductive blades aims at providing a retaining force on a silver contact so that the silver contact is more secure and does not break loose when subject to striking. The silver contact is built in a fastening section formed on a conductive blade. The fastening section has at least two fixing zones connecting to each other and a bucking end adjacent to the fixing zones to increase the retaining force between the silver contact and the conductive blade so that the silver contact does not break loose easily thereby increasing the service life thereof.

14 Claims, 10 Drawing Sheets

SILVER CONTACT FIXING STRUCTURE FOR CONDUCTIVE BLADES

FIELD OF THE INVENTION

The present invention relates to a silver contact fixing structure for conductive blades and particularly to a technique that employs a novel conductive blade structure and a silver contact fixing method to enhance the strength of silver contacts.

BACKGROUND OF THE INVENTION

Conventional techniques for fabricating silver contacts often encounter some problems, notably:

Silver contacts are usually used in switches to establish conductive connection. When in use, the silver contact receives a strike from a connection leg to form a connection contact with the switch. The conventional silver contact is generally wedged in a housing space. When subject to striking over a prolonged period, the silver contact is prone to break loose from the conductive blade.

To remedy the foregoing problem, a technique has been disclosed to improve the fabrication of silver contacts in R.O.C. patent publication No. 448454 entitled "Method for fastening silver contacts of conductive blades". It punches a fastening hole on a conductive blade that is concave on the upper side and convex on the lower side. Extra material of the conductive blade is extruded to form an extended wedging flange. The fastening hole has screw threads formed therein to provide a horizontal friction force so that the silver contact is less likely to break off. Finally, the top section of the silver wire is formed in a protrusive bucking flange through an upper mold, and a lower mold is deployed to ram the wedging flange towards the fastening hole so that the silver wire is filled and wedged securely in the fastening hole. The aforesaid technique can fix the silver contact more securely without breaking loose. However, in the design of switches, the interval between the movable contact and the closed circuit contact has to comply with safety regulations (for instance the interval under European safety regulations is 3 mm). The protrusive bucking flange will affect the distance between the movable contact and the closed circuit contact. Hence, the relative positions of the elements in the switch have to be rearranged.

Referring to FIG. 1, to resolve the problems set forth above, some people proposed an injection forming approach to embed the silver contact when the conductive blade is formed by injection. Such a design does not create the bucking flange, and the positions of the elements in the switch do not need to be rearranged. However, embedding by injection forming requires fabrication of new molds to suit the different contact sizes of various switches. Manufacturing processes cannot be modularized. As a result, manufacturing cost is higher.

SUMMARY OF THE INVENTION

The primary object of the invention is to solve the aforesaid problems. The invention provides a method and structure for fixing silver contacts more securely. The conductive blade has a fastening section corresponding to where a silver contact is located. The fastening section has at least two fixing zones formed on a corresponding vertical surface connected to each other, and a bucking end abutting the juncture of the fixing zones so that a silver wire may be pressed and filled in the fastening section to form the silver contact. Thus, a retaining force is provided when the connection leg strikes the silver contact. Moreover, the horizontal cross section of the fastening section may be formed in a non-circular and irregular shape to make the silver contact less likely to break loose.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
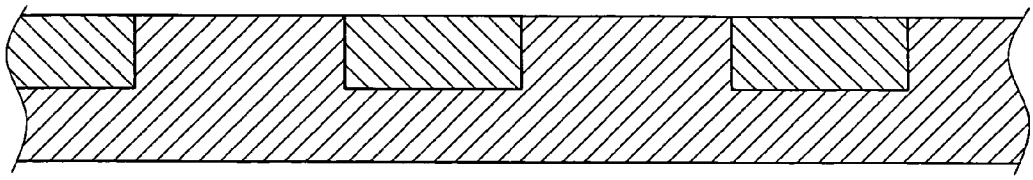
Fig. 1 PRIOR ART
FIG. 1 is a cross section of a conventional silver contact.
Figure 2:
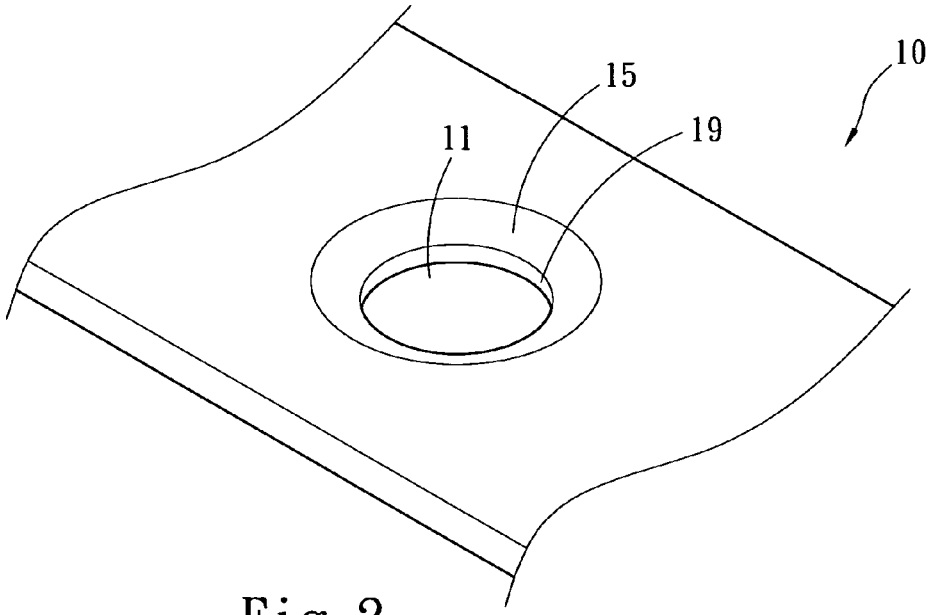
FIG. 2 is a perspective view of a first embodiment of the conductive blade of the present invention.
Figure 3A:
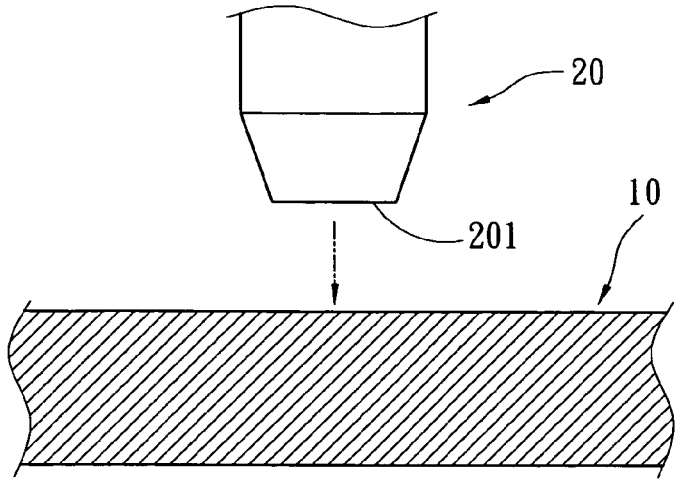
FIGS. 3A through 3F are schematic views of the fabrication process of the first embodiment of the invention.
Figure 3B:
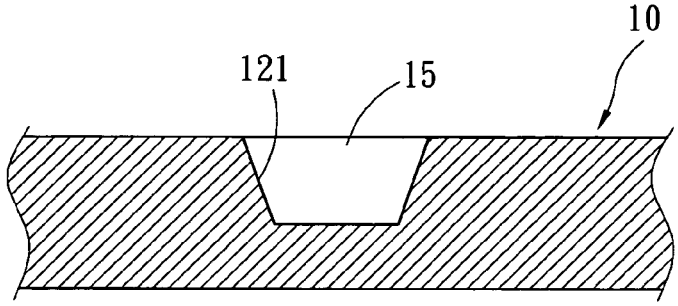
Figure 3C:
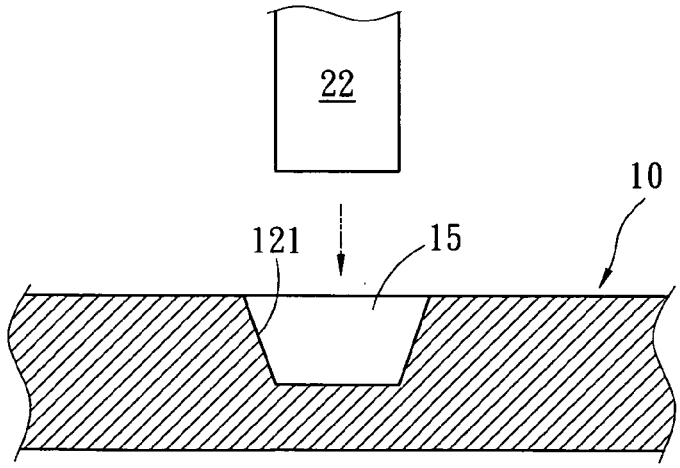
Figure 3D:
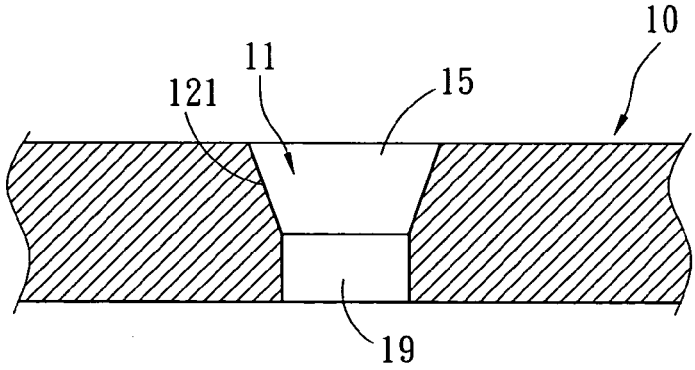
Figure 3E:
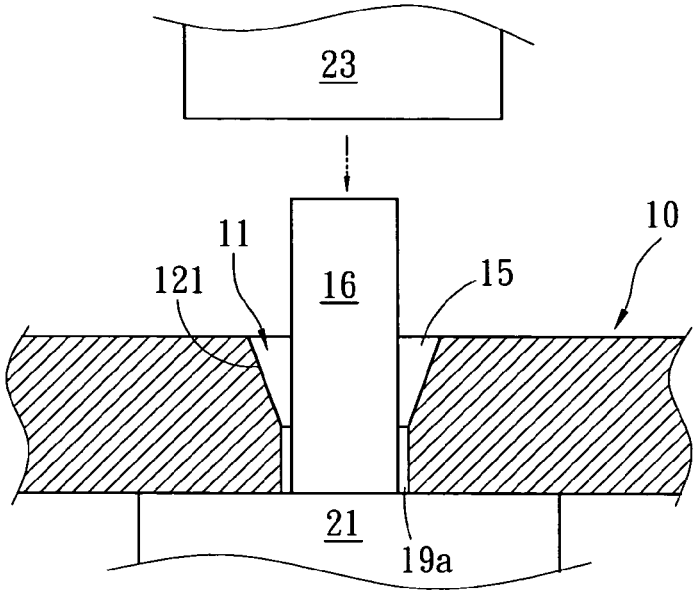
Figure 3F:
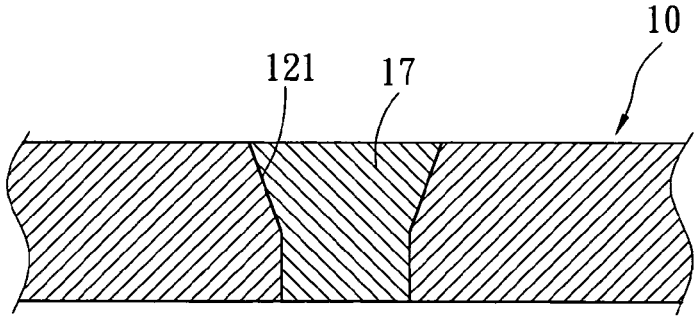
Figure 4:
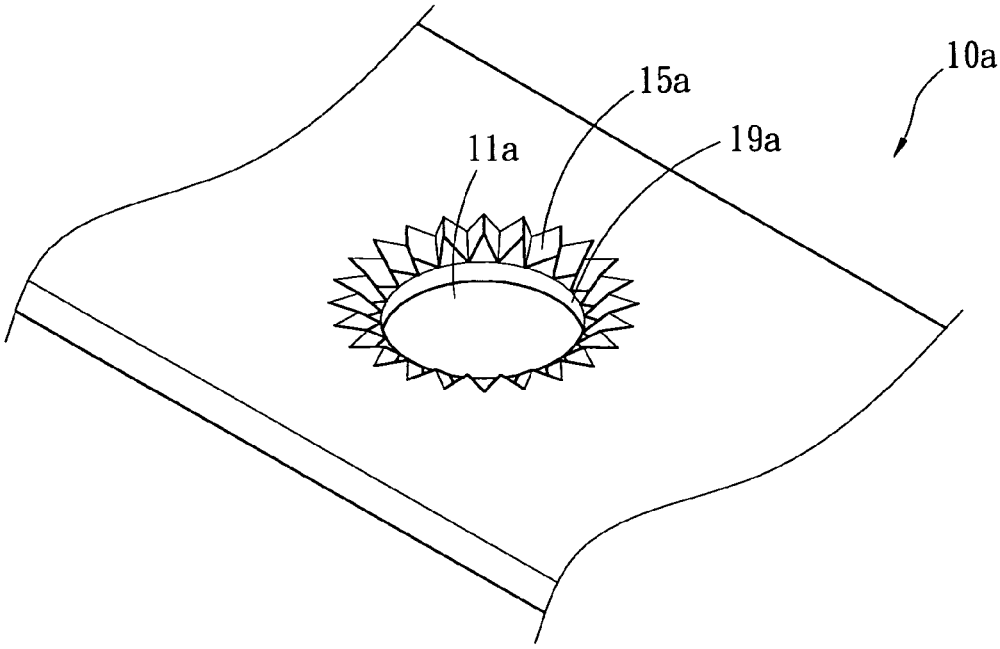
FIG. 4 is a perspective view of a second embodiment of the conductive blade of the present invention.
Figure 5:
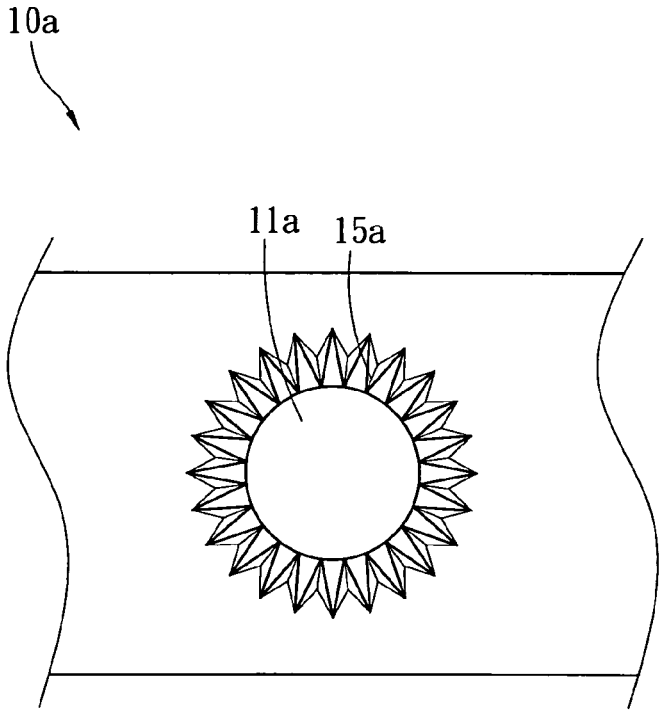
FIG. 5 is a top view of the second embodiment of the present invention.
Figure 6A:
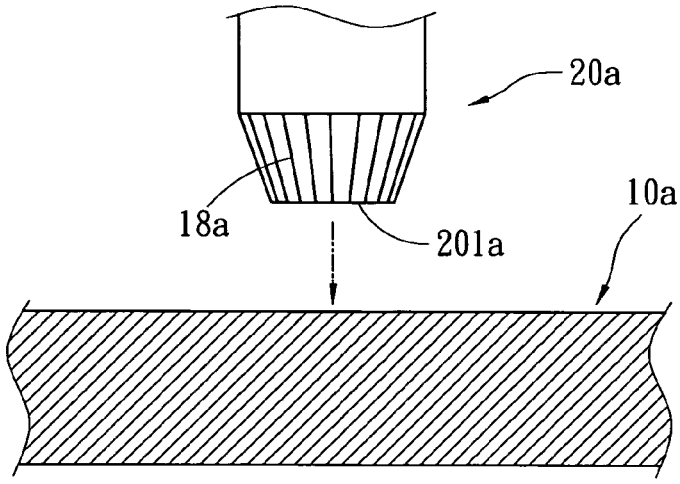
FIGS. 6A through 6F are schematic views of the fabrication process of the second embodiment of the invention.
Figure 6B:
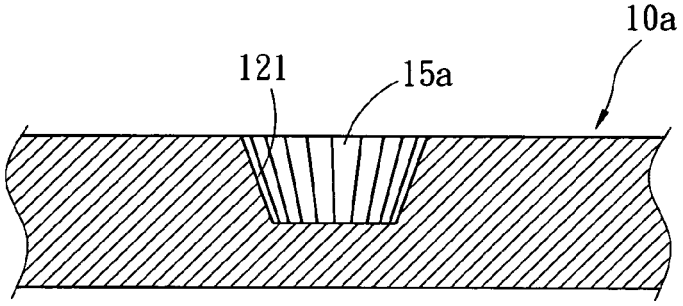
Figure 6C:
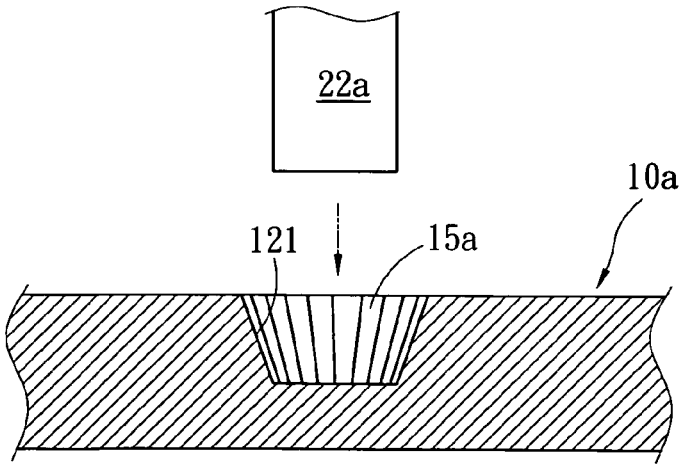
Figure 6D:
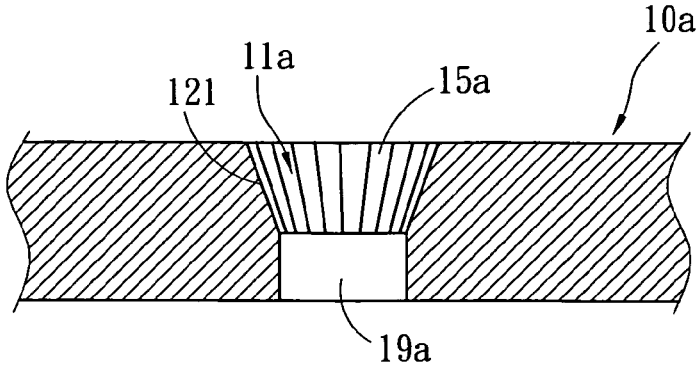
Figure 6E:
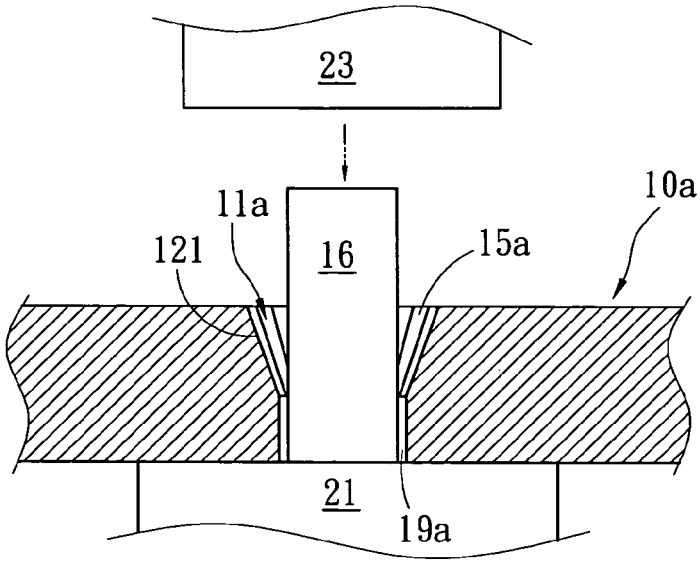
Figure 6F:
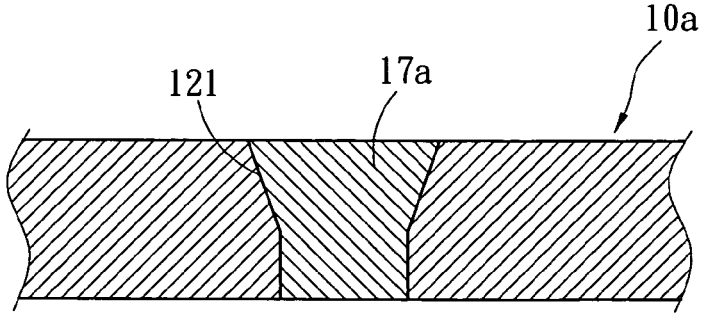

Please refer to FIGS. 2, 3-A through 3-F, and 13 for a conductive blade 10 of a first embodiment of the invention. It has a fastening section 11 corresponding to where a silver contact 17 is located. The fastening section 11 has a first fixing zone 15 and a second fixing zone 19 on a vertical surface corresponding to the conductive blade 10 that connects to each other. The first fixing zone 15 is greater than the second fixing zone 19 and forms a bucking end 121 at their juncture. A silver wire 16 is pressed and filled in the fastening section 11 to form a silver contact 17, which has the same shape as the fastening section 11. The bucking end 121 provides a retaining function to increase the retaining strength. Fabrication of the conductive blade 10 includes the following steps in the order of A: stamping a blank; B: stamping the blank for a second time; and C: planting the silver wire.

Step A: stamping a blank. Form the first fixing zone 15 on the conductive blade 10 by stamping through a punching end 201 of a first upper mold 20. The punching end 201 is a cylinder with a lower tapered end. The first fixing zone 15 has a bucking end 51 formed on the peripheral side of one end thereof in a chamfered angle.

Step B: stamping the blank for a second time. Form the second fixing zone 19 on the conductive blade 10 by stamping through a second upper mold 22. The first fixing zone 15 is bigger than the second fixing zone 19. The bucking end 121 is located on the peripheral side of one end of the first fixing zone 15 in a chamfered angle.

Step C: planting the silver wire. Place the conductive blade 10 on a first lower mold 21; press and fill the silver wire 16 in the fastening section 11 to become the silver contact 17 which has the same shape of the fastening section 11. The bucking end 121 strengthens the retaining ability.

Refer to FIGS. 4, 5, 6A through 6F for a second embodiment of the silver contact 17*a* of the invention. The conductive blade 10*a* is substantially constructed as the first embodiment. However, the first fixing zone 15*a* is formed in a saw shape. The process for fabricating the silver contact 17*a* includes the following steps in the order of A: stamping a blank; B: stamping the blank for a second time; and C: planting the silver wire.

Step A: stamping a blank. Form the first fixing zone 15*a* on the conductive blade 10*a* by stamping through a first upper mold 20*a*. The punching end 201*a* of the first upper mold 20*a* has an extended angle 18*a* with a lower tapered end formed in a saw shape.

Step B: stamping the blank for a second time through a second upper mold 22*a* smaller than the first upper mold 20*a* to form a second fixing zone 19*a* on the conductive blade 10*a* that is smaller than the first fixing zone 15*a*. The second upper mold 22*a* is a cylinder.

Step C: planting the silver wire. Place the conductive blade 10*a* on a first lower mold 21; place the silver wire 16 in the fastening section 11*a* which consists of the first fixing zone 15*a* and the second fixing zone 19*a*; press and fill the silver wire 16 in the fastening section 11*a* through a third upper mold 23 to finish the fabrication of the silver contact 17*a* of the second embodiment. The first fixing zone 15 has a bucking end 121 formed on the peripheral side of one end in a chamfered angle.

Figure 7:
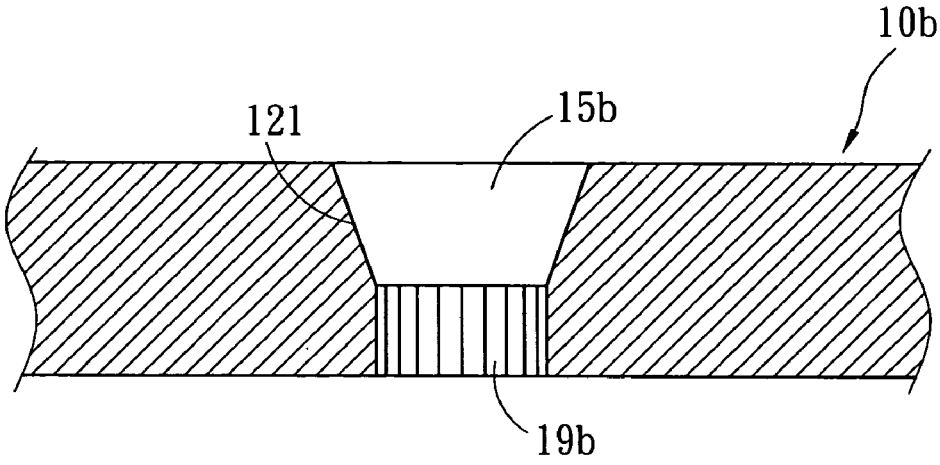
FIG. 7 is a cross section of a third embodiment of the present invention.
Figure 8:
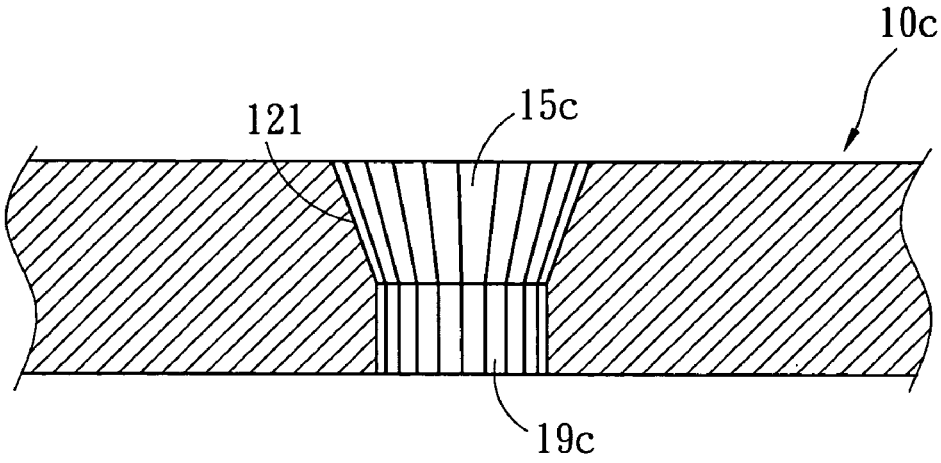
FIG. 8 is a cross section of a fourth embodiment of the present invention.
Figure 9A:
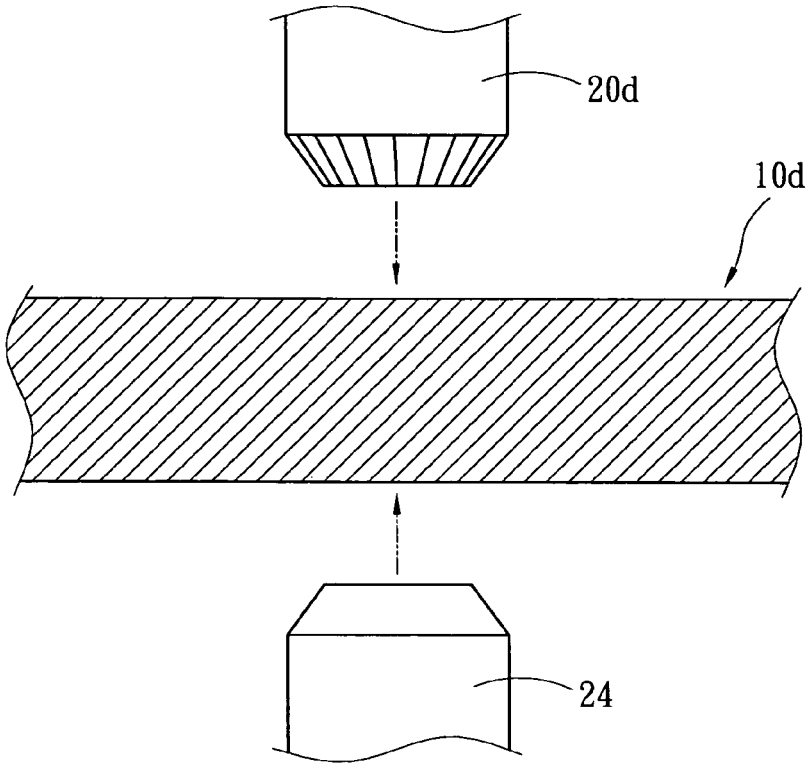
FIGS. 9A, 9B and 9C are cross sections of a fifth embodiment of the present invention.
Figure 9B:
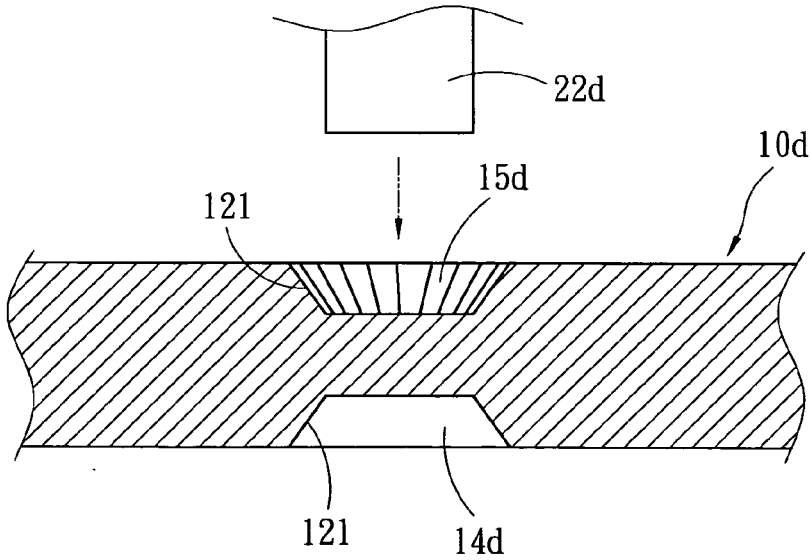
Figure 9C:
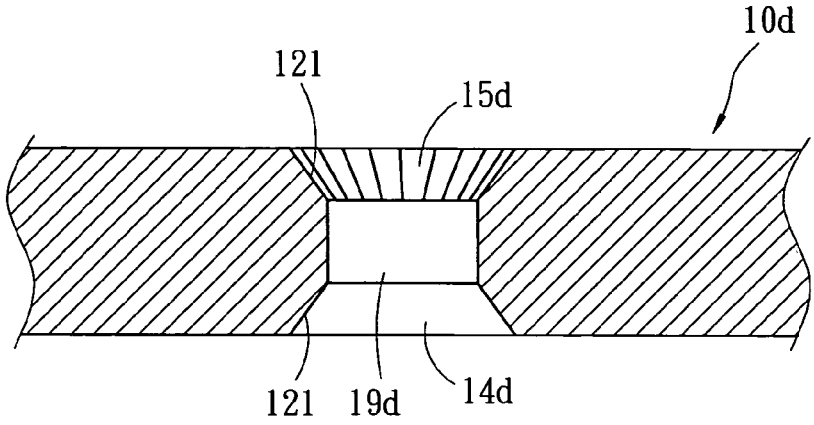

Refer to FIGS. 7 and 8 for the conductive blades 10*b* and 10*c* of a third and a fourth embodiment of the invention. They are formed in a shape substantially similar to the second embodiment. The fabrication step A for stamping a blank and the step B for stamping the blank for a second time and the step C for planting the silver wire (not shown in the drawings) set forth above are also applied. However, in the third embodiment, the first fixing zone 15*b* is a conical trough with a tapered lower end and the second fixing zone 19*b* is a circular trough with a saw type inner wall. In the fourth embodiment, the first and the second fixing zones 15*c* and 19*c* are formed in a saw type, and the first fixing zone 15*c* is a conical trough with a tapered lower end.

Refer to FIGS. 9A, 9B, 9C and 13 for a fifth embodiment of the invention. The fastening section includes first, second and third fixing zones 15*d*, 19*d* and 14*d*. The fabrication process includes A: stamping a blank; B: stamping the blank for a second time; and C: planting the silver wire.

Step A: stamping a blank. A first upper mold 20*d* and a second lower mold 24 are used to stamp a conductive blade 10*d* on the upper side and the lower side to form the first and third fixing zones 15*d* and 14*d*.

Step B: stamping the blank for a second time. From a second fixing zone 19*d* on the conductive blade 10*d* through a second upper mold 22*d* that is smaller than the first and third fixing zones 15*d* and 14*d*. The first and the third fixing zones 15*d* and 14*d* are conical troughs with a tapered end adjacent to the horizontal center of the conductive blade 10*d*. The first fixing zone 15*d* also has a saw type peripheral wall.

Step C: planting the silver wire (not shown in the drawings). The silver wire is placed in a fastening section 11*d* formed by the first, second and third fixing zones 15*d*, 19*d* and 14*d*, and is pressed and filled in the fastening section 11*d* through a third upper mold (not shown in the drawings).

Figure 10:
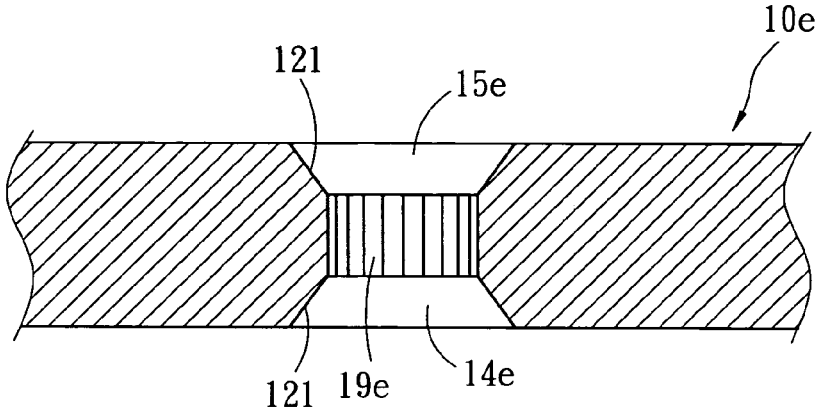
FIG. 10 is a cross section of a sixth embodiment of the present invention.
Figure 11:
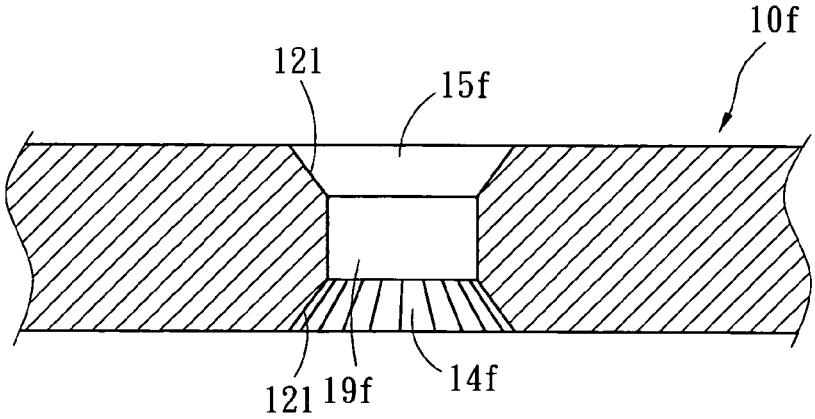
FIG. 11 is a cross section of a seventh embodiment of the present invention.
Figure 12:
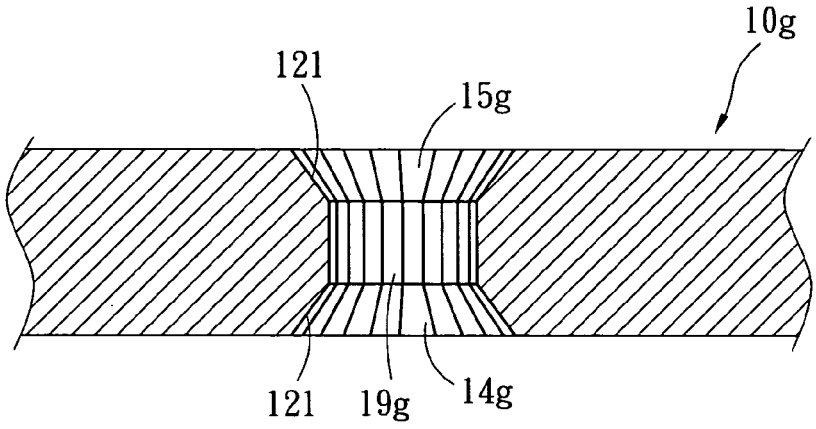
FIG. 12 is a cross section of an eighth embodiment of the present invention.
Figure 13:
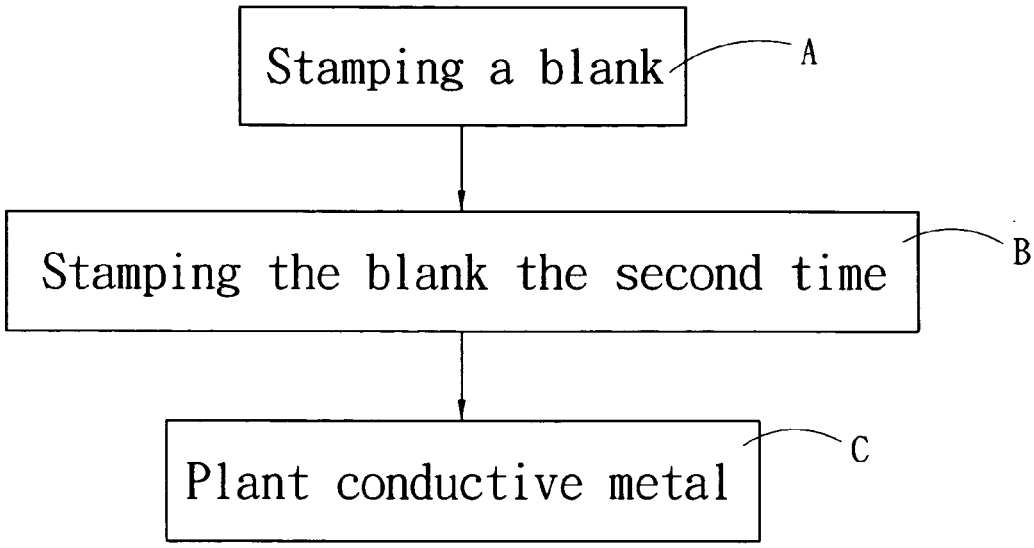
FIG. 13 is a block diagram of the fabrication process for the first embodiment through to the eighth embodiment of the invention.

Refer to FIGS. 10, 11 and 12 for a sixth embodiment (FIG. 10), seventh embodiment (FIG. 11) and eighth embodiment (FIG. 12). The fabrication processes are substantially the same as those previously discussed. The sixth embodiment includes a first, second and third fixing zone 15*e*, 19*e* and 14*e*. Only the second fixing zone 19*e* (FIG. 10) is formed in a saw type. The seventh embodiment includes a first, second and third fixing zone 15*f*, 19*f* and 14*f*. Only the third fixing zone 14*f* (FIG. 11) is formed in a saw type. The eighth embodiment (FIG. 12) includes a first, second and third fixing zone 15*g*, 19*g* and 14*g*, and all of them are formed in a saw type.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments that do not depart from the spirit and scope of the invention.

What is claimed is:

1. A silver contact fixing structure for conductive blades comprising a conductive blade which has a fastening section for holding a silver contact;

wherein the fastening section has a first fixing zone and a second fixing zone on a vertical surface corresponding to the conductive blade that connects to each other, the first fixing zone being greater than the second fixing zone and forming a bucking end on the juncture of the first fixing zone and the second fixing zone, a silver wire being pressed and filled in the fastening section to form a silver contact which is shaped as the fastening section to be retained by the bucking end to form a strengthened fixing, the silver contact structure is formed by a fabrication method which comprises the steps of:

A. stamping a blank by stamping the conductive blade with a first upper mold to form the first fixing zone;

B. stamping the blank for a second time by stamping the conductive blade with a second upper mold which is smaller than the first upper mold to form the second fixing zone which is smaller than the first fixing zone; and C. planting the silver wire by placing the conductive blade on a first lower mold, and placing the silver wire in the fastening section formed by the first fixing zone and the second fixing zone, and pressing and filling the silver wire in the fastening section through a third upper mold.

2. The silver contact fixing structure of claim 1, wherein the fastening section includes a third fixing zone on a surface opposing the first fixing zone and adjacent to the second fixing zone, the third fixing zone being larger than the second fixing zone to form another bucking end on the juncture of the third fixing zone and the second fixing zone.

3. The silver contact fixing structure of claim 1, wherein the horizontal cross sections of the first fixing zone and the second fixing zone are non-circular.

4. The silver contact fixing structure of claim 1, wherein the horizontal cross section of the first fixing zone is non-circular.

5. The silver contact fixing structure of claim 1, wherein the horizontal cross section of the second fixing zone is non-circular.

6. The silver contact fixing structure of claim 1, wherein the horizontal cross sections of the first fixing zone and the second fixing zone are non-circular.

7. The silver contact fixing structure of claim 1, wherein the fastening section includes a third fixing zone on a surface opposing the first fixing zone and adjacent to the second fixing zone, the third fixing zone being larger than the second fixing zone to form another bucking end at the juncture of the third fixing zone and the second fixing zone.

8. The silver contact fixing structure of claim 1, wherein the silver contact structure is further formed by a fabrication method which comprises the steps of:

A. stamping the blank with a third upper mold to form a third fixing zone on the stamping blade;

B. during the stamping of the blank for the second time, the conductive blade being smaller than the the third upper mold to form the second fixing zone which is smaller than both the first fixing zone and the third fixing zone; and C. during the planting of the silver wire, the silver wire is also in the third fixing zone.

9. The silver contact fixing structure of claim 8, wherein the horizontal cross section of the first fixing zone is non-circular.

10. The silver contact fixing structure of claim 8, wherein the horizontal cross section of the second fixing zone is non-circular.

11. The silver contact fixing structure of claim 8, wherein the horizontal cross section of the third fixing zone is non-circular.

12. The silver contact fixing structure of claim 8, wherein the horizontal cross sections of the first fixing zone, the second fixing zone, and the third fixing zone are non-circular.

13. The silver contact fixing structure of claim 1, wherein the silver contact is flush with both an upper surface and a lower surface of the conductive blade.

14. The silver contact fixing structure of claim 1, therein the first fixing zone is conically shaped.

* * * * *